US009470499B2

(12) United States Patent
Benson

(10) Patent No.: US 9,470,499 B2
(45) Date of Patent: Oct. 18, 2016

(54) EXPLOSIVE DISRUPTION CONTAINER

(71) Applicant: Mark Benson, San Diego, CA (US)

(72) Inventor: Mark Benson, San Diego, CA (US)

( * ) Notice: Subject to any disclaimer, the term of this patent is extended or adjusted under 35 U.S.C. 154(b) by 0 days.

(21) Appl. No.: 14/346,732

(22) PCT Filed: Sep. 21, 2012

(86) PCT No.: PCT/US2012/056755
§ 371 (c)(1),
(2) Date: Mar. 23, 2014

(87) PCT Pub. No.: WO2013/044171
PCT Pub. Date: Mar. 28, 2013

(65) Prior Publication Data

US 2014/0224101 A1 Aug. 14, 2014

Related U.S. Application Data

(60) Provisional application No. 61/538,728, filed on Sep. 23, 2011.

(51) Int. Cl.

| | |
|---|---|
| ***F42D 5/04*** | (2006.01) |
| ***F42B 1/02*** | (2006.01) |
| ***F42B 3/02*** | (2006.01) |
| ***F42B 33/06*** | (2006.01) |

(52) U.S. Cl.
CPC . *F42D 5/04* (2013.01); *F42B 1/02* (2013.01); *F42B 3/02* (2013.01); *F42B 33/06* (2013.01)

(58) Field of Classification Search
CPC ..... F42D 5/04; F42B 33/06; F42B 33/067
USPC ..... 86/50
See application file for complete search history.

(56) References Cited

U.S. PATENT DOCUMENTS

| | | | | |
|---|---|---|---|---|
| 3,275,098 | A * | 9/1966 | Filler | 181/116 |
| 4,920,852 | A | 5/1990 | Miller | |
| 5,435,250 | A | 7/1995 | Pollock | |
| 6,269,725 | B1 | 8/2001 | Cherry | |
| 6,581,521 | B1 * | 6/2003 | Dixon et al. | 102/368 |
| 7,299,735 | B2 | 11/2007 | Alford | |
| 2007/0209500 | A1 | 9/2007 | Wilber | |
| 2012/0097015 | A1 * | 4/2012 | Alford et al. | 86/50 |

FOREIGN PATENT DOCUMENTS

| | | | |
|---|---|---|---|
| GB | 2 445 037 | A * | 6/2008 |
| WO | WO 2010-146340 | A2 | 12/2010 |

* cited by examiner

*Primary Examiner* — Stephen M Johnson
(74) *Attorney, Agent, or Firm* — Gorman IP Law, APC

(57) ABSTRACT

The current invention concerns an apparatus that is an explosive disruption device and a method for its use. The apparatus includes an internal container which holds an explosive charge, an external container which holds the internal container and a screw lid which holds the internal container in place within the external container.

12 Claims, 5 Drawing Sheets

EXPLOSIVE DISRUPTION CONTAINER

CROSS-REFERENCE TO RELATED APPLICATIONS

This Nonprovisional application is the National Phase Under 35 U.S.C. §371 of PCT International Application No. PCT/US2012/056755 filed Sep. 21, 2012, which claims priority under 35 U.S.C. §119 of U.S. Provisional Application No. 61/538,728 filed on Sep. 23, 2011, the entire contents of each of which are hereby incorporated by reference in their entirety.

TECHNICAL FIELD

Embodiments of the present invention relate to the technical field of explosives. More particularly, the embodiments of the present invention are directed to explosive disruption containers, also known as explosive disruption tools or explosive disruption devices.

BACKGROUND OF THE INVENTION

Improvised explosive devices (IEDs) present a danger to life and property. Currently, personnel that disarm IEDs utilize several different types of explosive disruption containers in order to separate the explosive components of the firing train, which is more commonly known in the art as "rendering safe" the device. Explosive disruption containers currently used are typically essentially cylindrical in shape (see US 2007/0209500, for example). They are also omnidirectional in functionality; that is, the cylindrical shape of the explosive disruption container forces a working fluid that surrounds the explosive inserted in the explosive disruption container to be explosively driven in a mostly outward, cylindrical, and uniform manner upon detonation. Omnidirectional disruption containers are primarily used as "general" disrupters to disrupt small and medium sized IEDs. They can also be used when it is advantageous that the kinetic energy of the container is transferred in a 360 degree arc. These types of targets may include clearance or general disruption of debris piles, culverts, dumpsters, or even the interior of a car.

Explosive disruption containers may also be directional. In a directional disruption container the explosive energy associated with a detonation is primarily concentrated in essentially only one direction (see, for example, U.S. Pat. No. 6,269,725). Directional disruption tools most commonly use a combination of explosive tamping and a geometric shape charge configuration in order to achieve the desired effects. Here, the explosive tamping is water, or other fluids, which slows down the explosive pressure on passive explosive fronts and causes a dampening of the explosive effects to create a path of least resistance along a primary axis. The greater velocities of fluids along the primary axis makes directional disruption containers advantageous for use against hardened targets such as suitcases or metal containers.

Many current disruption containers routinely require individuals to hand pack explosives within the container. This process can require separating small pieces of explosives from the original packaging. It also requires the operator to utilize a dowel or similar device to compress the explosives into dense layers within at least some portion of the explosive disruption tool to ensure continuity between the small separate pieces of the explosive. In addition to compressing the explosive, operators routinely utilize explosive boosters as a part of the explosive train in order to increase the energy needed to initiate the main charge.

This process of hand packing and compressing explosives within an explosive disruption container can lead to higher misfire rates when explosive disruption tools are fully assembled, charged, and stored prior to their use. Explosives are manufactured and delivered according to manufacturer specification (or military specification, a.k.a. "MILSPEC") standards that relate to controlling the density and composition of the explosive. Consequently, upon removing the explosive from its original protective wrapping and hand packing the explosive within the container, the manufacturer specifications are no longer valid. The potential for introduction of foreign debris from the surrounding environment, the modification of the explosive's density, and the exposure to ultraviolet radiation are just some of the external factors that contribute to the explosive's degradation process.

The process of hand packing and assembling explosive disruption containers is not only labor intensive but also requires time. A single explosive disruption container may take several minutes to hand pack and assemble. Administrative time is also considerable. If the explosive disruption tools are constructed and stored to be ready for response operations, then personnel expend great efforts to account for withdrawing demolition materials from storage containers, setting explosive safety boundaries, creating safe working environments, and storing the pre-built tools for response operations. Administrative time is also spent tracking the amount of explosives used. For current explosive disruption containers, this requires the operator to weigh the amount of explosive prior to it being inserted and compressed within the container.

Utilizing hand packed explosive disruptor tools may also be costly. Once explosive disruption containers are assembled and hand packed, they are routinely stored for emergency response operations. Operators oftentimes rotate the inventory in a storage container due to degradation of the explosive and the plastic used for plastic explosive disruptor containers. A response team that must detonate numerous explosive disruption containers on a monthly basis and construct replacement explosive disruption containers can endure heavy costs after only a short time.

Standard demolition procedures exist for methods of priming, or inserting, blasting caps into plastic explosives. These procedures dictate the exact dimensions that a blasting cap must penetrate into the explosive to ensure the highest probability of detonation upon initiation. Standard demolition procedures also suggest that explosives should be dual primed; that is, two initiating systems should be inserted into the explosive. As stated in the Naval Sea Systems Command publication NAVSEA SWO60 "Dual priming explosives leads to fewer system misfires. This, in turn, leads to time saved during training and may save lives during battle." Current disruption explosive tools do not take into account many of these standard demolition procedures.

The majority of explosives used within explosive disruption containers are toxic and contain large amounts of cyclotrimethlyenetrinitramine ("RDX"). The acute effects of RDX ingestion include staring into space, generalized seizures, lethargy, coma, muscular twitching, hyperreflexia, myalgia, headaches, vomiting, mild renal injury, and hematuria (see Kaplan, A S, Berghout C F, Peczenik A. Human intoxication from RDX. *Arch Environmental Health* 1965; 10: 877-83 and Stone W J, Paletta T L, Heimann E M, Bruce J I, Knepshield J H. Toxic Effects following ingestion of C-4 Plastic Explosive. *Arch Intern Med* 1969: 124: 726-30). Reducing the exposure of toxic compounds during the process of hand packing explosives into the explosive disruption containers remains an issue and adhering to strict procedures during the hand packing process may not always be feasible in wartime environments.

Therefore, there is a need to manufacture explosive disruption containers that take these considerations into account.

Accordingly, a solution is needed that will not only provide the operator the ability to assemble an explosive disruption container efficiently, but will also reduce the need to hand pack explosives within that container. Such an explosive disruption container would also be beneficial if it possessed performance characteristics that enabled it to be used against both general and directional targets. Performance characteristics include the velocity and kinetic energy of the projectile or fluid that is expelled outward from the explosive disruption container due to the detonation of the device.

BRIEF SUMMARY OF THE INVENTION

The present invention provides operators the ability to rapidly assemble an explosive disruption container. Such an explosive disruption tool enables personnel to utilize the tool as a general disruption tool or as a directional disruption tool. The explosive disruption tool also allows adherence to standard demolition procedures, allows for quick assembly of the tool, and does not require hand packing of explosive or boosters.

The present invention provides for the first time a multidirectional disruption container. Here, the tamping and geometric shape charge are configured so that there are only a discrete number of axes. A multidirectional disruption container has more than a single primary axis. It does not have the full and equal 360 degree arc pattern of kinetic energy dispersal associated with omnidirectional disruption containers. This difference is illustrated in FIG. 2. By altering the dimensions of the explosive charge in the multidirectional disruption container, the kinetic energy can be dispersed along the axes in equal amounts or to favor one or more axes. Consequently, multidirectional disruption containers can be used against the same "general" targets as omnidirectional disruption containers as well as being configured to serve as directed disruption containers.

The present invention provides an explosive disruption container that is multidirectional or directional in nature and utilizes a container that is configured to reflect the shape of many standard manufactured explosives. Such a design makes it possible for the operator to simply cut the amount of explosive required and set it into the dedicated chamber, instead of having to hand pack and compress explosives into the explosive disruption container. External features on the surface of the explosive disruption container assist operators with cutting and inserting the correct volumetric dimensions of explosives required.

It is an objective of the present invention to provide an explosive disruption tool that can be assembled within seconds by quickly cutting and inserting an appropriate amount of explosive into the explosive disruption container. This action decreases the operator's contact time with the toxic explosive, decreases the time it takes to assemble the container, and ensures that the explosive used maintains the manufacturer's recommended specifications for explosive density and composition. By forgoing the hand-packing operations, compression devices and explosive boosters are also not required.

It is yet another objective of the present invention to provide the operator with a system that does not have to be pre-assembled and stored for emergency response operations. The ability to rapidly assemble the explosive disruption container enables the operator to assemble the device on scene as needed, instead of having to pre-assemble, charge, and store numerous explosive disruption containers in a ready-service-locker or explosive magazine. Such a practice saves money due to the decrease in inventory turnover and the decrease of administrative and operational time required for storage.

It is yet another objective of the present invention to provide the operator with the ability to record the amount of explosive used by volume, and not by weight. This reduces administrative time because current inventory systems used by military personnel are commonly based upon the volumetric amount of explosives used. For instance, a standard M112 Block of C-4 is 11 inches by 2 inches by 1 inch. If an operator uses one half of the C-4 block, then the operator may record the amount used as "½ block." Current explosive disruption tools require the operator to weigh the amount of explosives used. Converting between volume and weight is cumbersome and time consuming.

It is another objective of the present invention to provide a system that allows the operator the opportunity to utilize standard demolition techniques to increase the chance of a successful detonation. The present invention provides operators the capability to utilize dual priming techniques, as well as enabling operators to insert one or more blasting caps within the plastic explosive with proper spacing, therefore making explosive boosters obsolete.

It is still another objective of the present invention to enable at least one blasting cap to be secured within the explosive disruption device and which can withstand external strain placed on the initiation system. Such a device will reduce the chances that the blasting cap is inadvertently dislodged during placement of the tool.

It is also an intent of the present invention to be used with standard military explosives and commercial explosives. While military explosives are generally rectangular in design and have a shape and size that is in common with the shape and size of the internal and external containers presented in this invention, it can be seen that it may be advantageous for personnel that utilize explosives that are manufactured and delivered in square or less typically sized rectangular blocks to altering the container configurations to accommodate the delivery dimensions of the explosive block.

It is also an intent of the present invention to direct the kinetic energy and velocity of the explosive along two primary axes which correspond to the surface area of the explosive inserted into the explosive disruption container. This design leads to much greater kinetic energy levels and working fluid velocities than an omnidirectional tool because an omnidirectional tool dissipates energy along an infinite number of cylindrically arranged outward vectors.

BRIEF DESCRIPTION OF THE DRAWINGS

The present invention will become more fully understood from the detailed description given herein below and the accompanying drawings which are given by way of illustration only, and thus are not limitative of the present invention.

DETAILED DESCRIPTION OF THE INVENTION

Figure 1:
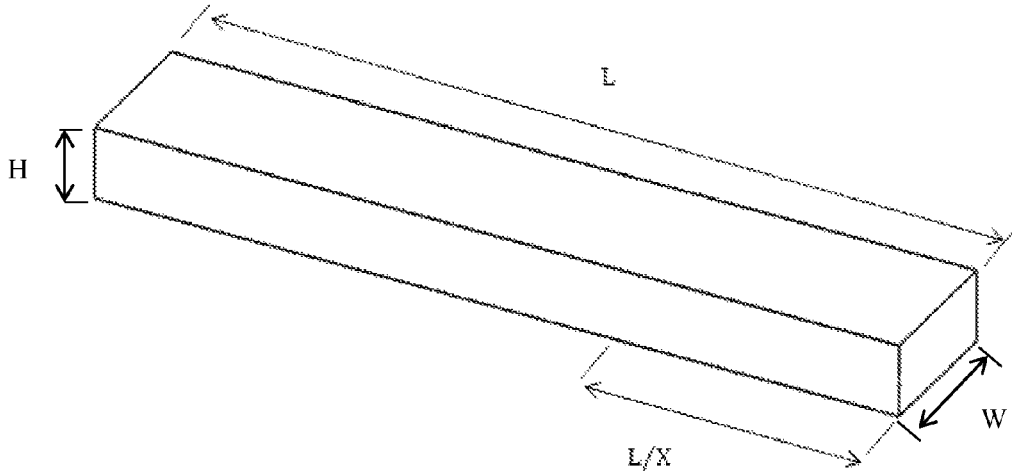
FIG. 1 is a perspective view of one configuration of plastic explosive as provided by the manufacturer to the end user.

FIG. 1 Possible plastic explosive manufactured shape. FIG. 1 illustrates one possible shape of the explosive that may be provided by a manufacturer and which is typically enclosed within protective wrapping and has measurements of Width [W]×Length [L], and Height [H]. One can recognize that the dimensions W×L×H may represent a cube or any six sided polygon.

The present invention discloses the case for L/X, where L/X represents the fraction of the Length [L] chosen to be used for one size of the explosive disruption container. For instance, a one half block of C-4 would be represented as "½×L." A quarter block would be "¼×L," a full block would be "L," and two blocks would be "2×L." L/X may be unconfined to a single axis. For small volumes, such as "⅛×L," it may be advantageous to simultaneously rotate the axis of the explosive, the interior container, and/or the exterior container, in order to maintain the desired orientation.

Figure 2:
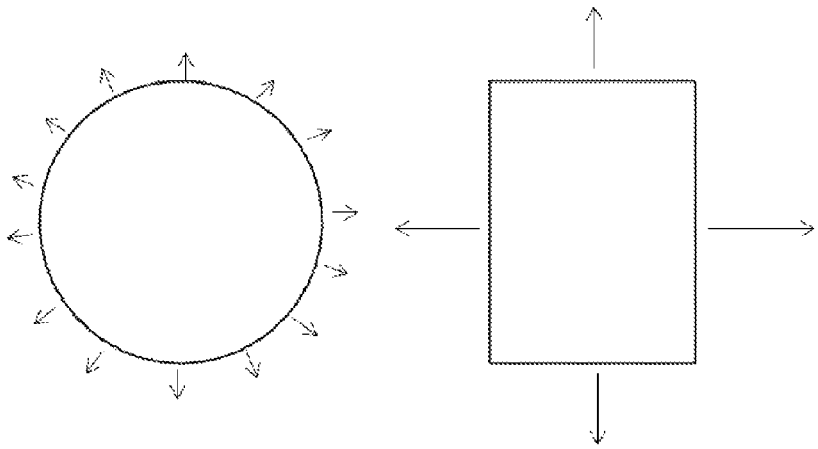
FIG. 2 is a top view of a multidirectional and omnidirectional explosive showing the related resultant energy vectors upon the detonation of explosives.

FIG. 2 Resultant energy vectors are greater along two primary axis compared to a 360 degree arc. FIG. 2 illustrates the relationship between an omnidirectional and multidirectional explosive disruption container where the surface area of the omnidirectional explosive disruption container transfers energy throughout a 360 degree arc and the multidirectional explosive disruption container transfers energy along two primary axes. FIG. 2 demonstrates that a multidirectional explosive disruption tool has resultant energy vectors greater than an omnidirectional explosive disruption tool and that energy focused along the primary axes increases the explosive effects. This enables the multidirectional explosive tool to be used as either a general disruptor or as a directional disruptor by altering the dimensions of the explosive charge to deliver explosive energy in equal amounts along the axes or to deliver unequal amounts of explosive energy.

Figure 3:
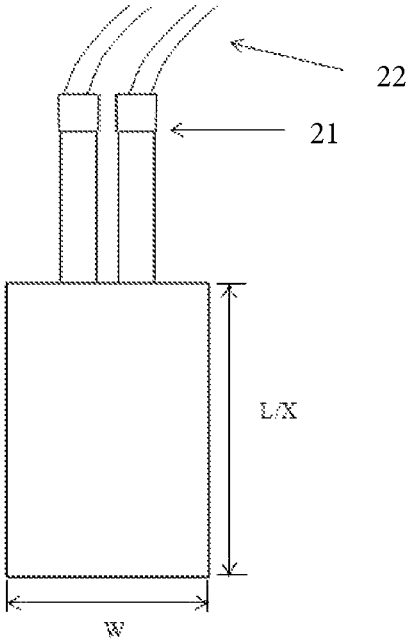
FIG. 3 is a front view of the plastic explosive cut to size and prepared for use in accordance with one embodiment of the present invention.

FIG. 3 Configuration of plastic explosive for insertion into interior container. FIG. 3 illustrates an explosive that has been cut to length L/X, where X matches the Width [W] for one orientation of the material, and the Height [H] for a second orientation of the same material. Two Blasting Caps 21 and Initiation Systems 22 are shown. FIG. 3 also shows the explosive as being dual primed, surrounded by the appropriate explosive suggested for the most probable detonation. Note that a secondary booster charge is not required.

Figure 4:
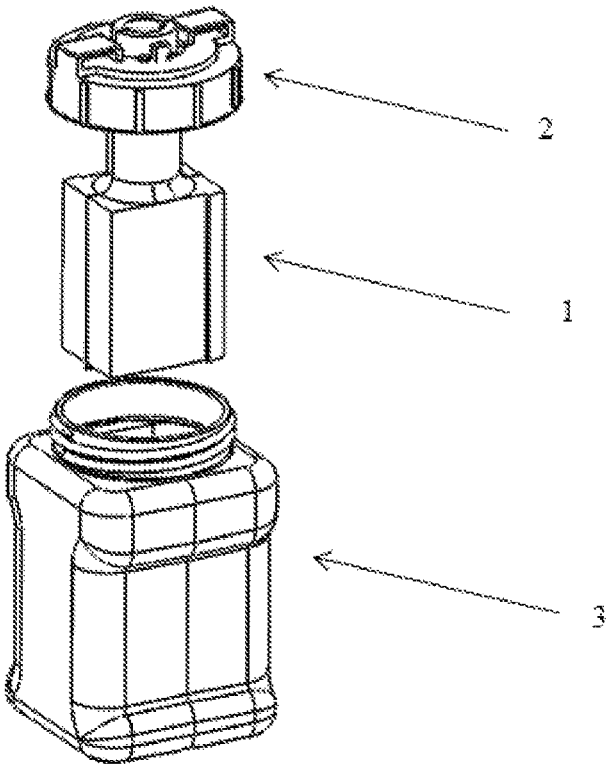
FIG. 4 is a perspective view of the explosive disruption container in accordance with one embodiment of the present invention.

FIG. 4 Multidirectional Explosive Disruption Container. FIG. 4 illustrates a multidirectional explosive container that has an internal container 1, a screw lid 2, and an exterior container 3. All components may be constructed of plastic or similar materials, or any material that is intended to fail upon detonation of the explosive contained therein.

Figure 5:
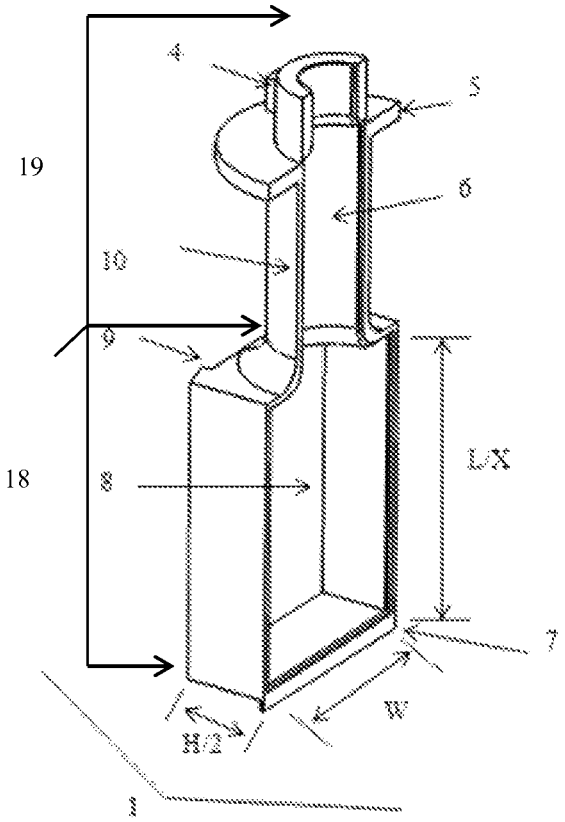
FIG. 5 is a cross sectional view of the interior container in accordance with one embodiment of the present invention.

FIG. 5 Cross Section of Interior Container. FIG. 5 is a diagram of the interior container 1, which has a securing extrusion 4, a support bracket 5, an initiation channel 6, a hinge 7, an interior void 8, an external measurement for L/X 9, and a seal groove 10.

The interior container 1 has a rectangular body 18 with a cylindrical extrusion 19 on one surface. The interior container 1 is open on one face and consists of an internal and outer wall. Two interior containers 1 are combined and closed by means of a hinge 7 in order to suspend the interior container 1 within the rectangular or square cavity of the exterior container 3. The rectangular interior void 8 is designed to hold the explosive and the dimensions of the rectangular inner void 8 are slightly larger than the explosive itself. The dimensions of the interior void 8 within the interior container 1 are slightly larger than the width [w]× height[h]×length [l], which coincide to the length L/X× Width [W]×Height [H] of the explosive cut from the original manufactured block.

The interior container 1 is secured to the screw lid 2 utilizing a twisting action, for example, a twisting action of approximately 35 degrees. This is done by first feeding the securing extrusion 4 through the underside of the screw lid 2 at the twist lock opening 12. The support bracket 5 ensures the interior container 1 maintains a cordial orientation within the exterior container 3 and reduces deflection when in use.

FIG. 5 also demonstrates the location of the blasting caps and initiation system that are secured between the initiation channel 6. The initiation channel 6 has a large enough diameter to support multiple initiation systems and blasting caps, such as two initiation systems and two blasting caps. Such a design ensures that the explosive disruption charge has the greatest chance to function as designed.

The hinge 7 connects two interior containers 1 on one edge. The hinge 7 can be any type of hinge including a living hinge, a pin hinge, a butt hinge, a butterfly hinge, a flush hinge, a barrel hinge, a concealed hinge and a continuous or piano hinge. The hinge 7 allows the interior containers 1 to quickly close and supports the water tight integrity of the interior container 1. A seal groove 10 is also presented on the face of the interior container 1 to support a seal in order to maintain water tight integrity. Lastly, the external extrusion 9 on the rear face of the interior container 1 enables the operator to quickly measure the amount of explosive to be inserted into the interior void 8.

Figure 6:
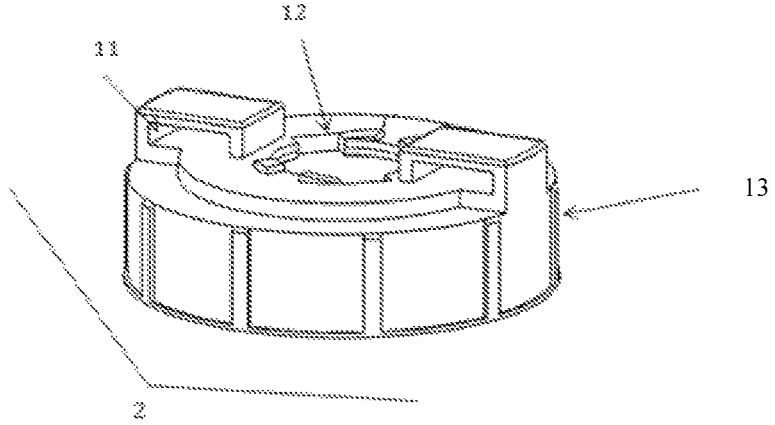
FIG. 6 is a perspective view of the screw lid in accordance with one embodiment of the present invention.

FIG. 6 Screw Lid. FIG. 6 is a diagram of the screw lid 2, and comprises a securing feature 11, a twist lock opening 12, ribs 13, and quick threads 14 (not shown) located on the internal wall of screw lid 2.

The screw lid 2 is a cylindrical body with internal and external walls and a flat surface on the top face. The screw lid 2 is used to contain the disruption medium or explosive tamping within the exterior container 3. Disruption medium or explosive tamping may include water, sand, gels, gases, or other materials that act primarily as incompressible fluids under extreme pressures, as is common with the detonation of energetic materials. The screw lid 2 is also used to support the interior containers 1 within the center of the exterior container 3. The connection of the interior containers 1 occurs with the screw lid 2 at the securing feature 11 and is secured into position via the interaction of the securing extrusion 4 with the twist lock opening 12.

The screw lid 2 is also quickly attached to the exterior container 3 through the use of the quick threads 14 located on the internal wall of screw lid 2 and the outer wall of the opening of exterior container 3. Ribs 13 are provided to allow the operator to grip and efficiently twist the screw lid 2 onto the quick threads 14.

Figure 7:
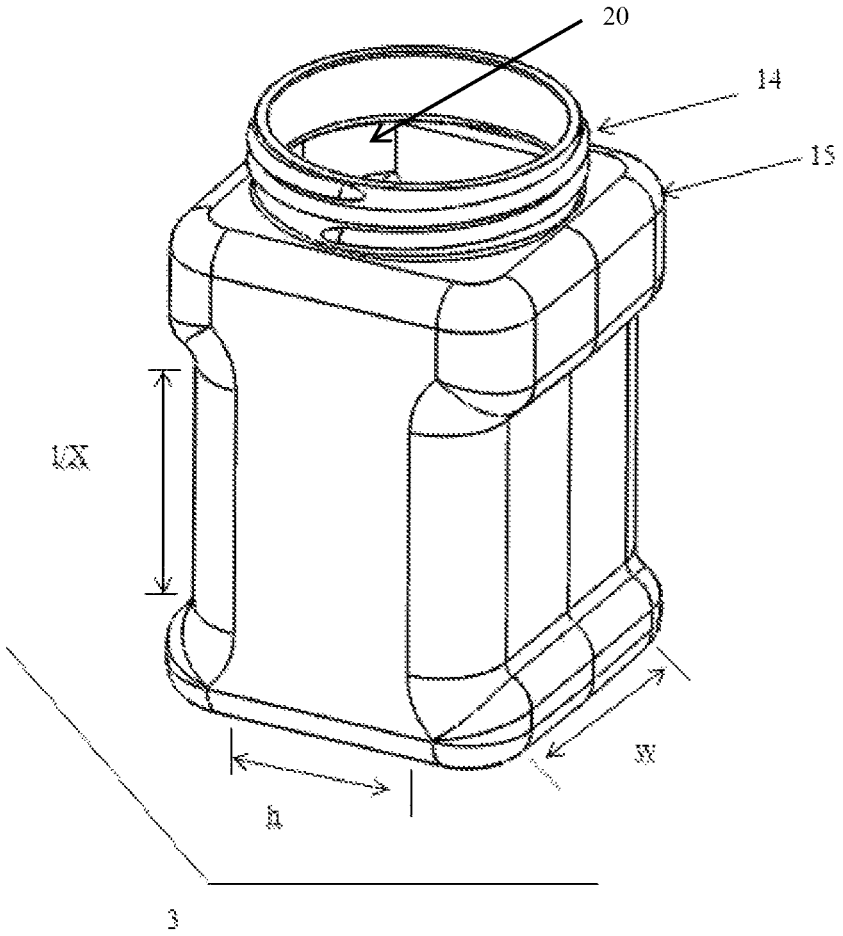
FIG. 7 is a perspective view of the exterior container in accordance with one embodiment of the present invention.

FIG. 7 Exterior Container. FIG. 7 is a diagram of the exterior container 3. The exterior container 3 is a shell that is rectangular or square in design with a single opening 20 having quick threads 14 located on the exterior wall of the opening 20, and fillets 15. The exterior container 3 allows containment of disruption medium within the exterior container 3, serves as the primary support for the interior container 1 and screw lid 2, allows insertion of tamping to reduce the explosive wave fronts above and below the explosive and at each corner of the exterior container 3, and enables operators to align the multidirectional disruption tool utilizing its external curvature.

The width [w], height [h], and length [l/X] of the exterior container 3 are distances that essentially coincide with the explosive having dimensions W×H×L/X. The dimensions of the exterior container 3 are directly related to the dimensions of the explosive. The dimensions of the exterior container 3 vary to coincide with the desired effects of a multidirectional explosive disruptor container. In addition to the dimensional relationships of the exterior container 3 and the explosive, a dimensional relationship also exists for the radii of the fillet 15. This dimensional relationship exists in order to optimize the explosive effects of the energetic material with the curvature and volume of the contained medium. These fillets 15 also serve as robot supports for remote delivery, and provide visual aim points for operators to align the multidirectional explosive disruptor tool with the intended target.

Operation of Device

The explosive disruption tool is designed to be used with standard blocks of rectangular or square shaped composition explosives, depending on factory delivered configurations and specifications. It may also be hand packed in the event that factory delivered configurations do not match the exact dimensions of the interior container 1.

Upon the need to utilize an explosive disruption container, an operator may utilize the measurement extrusion 9 on the exterior wall of the interior container 1 to accurately measure the L/X required for the container. Once cut, the explosive may be primed in with explosive detonators. The entire system is then laid within the interior chamber void 8 and the initiation channel 6 of the interior container 1.

A second interior container 1 that is connected to the first interior container 1 via a hinge 7, is then closed into position. The entire closed interior container 1 is then inserted through the screw lid 2 by aligning the securing extrusion 4 through the twist lock opening 12 of the screw lid 2. The interior container 1 is then secured to the screw lid 2 by turning the interior container 1. The interior container 1 is then positioned into place within the exterior container 3 and secured via engaging the quick threads 14 located on the interior wall of the screw lid 2 and the outside wall of the opening 20 of the exterior container 3.

Once the explosive disruption container is assembled, the operator may employ the tool to explosively disrupt an improvised explosive device or may utilize the tool as a general disruption tool.

I claim:

1. An explosive disruption device, comprising:

an external container;

a screw lid with a through hole and a locking structure, wherein the screw lid is screwed onto the top of the external container; and an internal container located within the external container and locked to the locking structure of the screw lid, wherein the interior container includes an external extrusion that forms a substantially cuboid-shape interior space for receiving an explosive material and, wherein the interior container is formed of a right-half structure, a left-half structure, and hinge directly connecting the right-half structure and the left-half structure.

2. The explosive disruption device of claim 1, wherein the interior container further includes:

an initiation channel extending from the substantially cuboid-shape space and through the through hole, the initiation channel supporting at least one blasting cap; and a securing extrusion locked to the locking structure of the screw lid.

3. The explosive disruption device according to claim 1, further comprising an explosive material.

4. The explosive disruption device according to claim 3, wherein the explosive disruption device concentrates explosive energy along two primary axes on detonation.

5. A method of operating an explosive disruption device, the explosive disruption device comprising:

an external container;

a screw lid with a through hole and a locking structure, wherein the screw lid is screwed on top of the external container; and an internal container located within the external container and locked to the locking structure of the screw lid, wherein the interior container includes an external extrusion that forms a substantially cuboid-shape interior space for receiving an explosive material;

the method comprising:

providing the explosive material;

measuring the explosive material using the external extrusion of the internal container and cutting a block of the explosive material based on measurement of the explosive material; placing the block of the explosive material into the substantially cuboid-shape interior space of the external extrusion;

inserting the internal container through the through hole of the screw lid and locking the internal container to the screw lid;

inserting the internal container entirely into the external container;

screwing the screw lid onto the external container.

6. The method of claim 5, wherein the interior container is formed of a right-half structure, a left-half structure, and a hinge directly connecting the right-half structure and the left-half structure, and the step of placing the block of the explosive material into the substantially cuboid-shape interior space of the external extrusion includes:

placing the block of the explosive material into one of the right-half structure and the left-half structure;

closing the other one of the right-half structure and the left-half structure to the one of the right-half structure and the left-half structure, such that the block of the explosive material is located within the substantially cuboid-shape interior space of the external extrusion formed by the right-half structure and the left-half structure.

7. The method of claim 5, wherein the explosive disruption device concentrates explosive energy in two axes on detonation.

8. The method of claim 7, wherein the concentration of explosive energy along the two axes is equal.

9. The method of claim 7, wherein the concentration of explosive energy along the two axes is not equal.

10. The method of claim 5, further comprising detonating the explosive disruption device.

11. The method of claim 5, further comprising placing the explosive disruption device within range of a target.

12. The method of claim 11, further comprising detonating the explosive disruption device.

* * * * *